US008870725B2

(12) United States Patent
Harris

(10) Patent No.: US 8,870,725 B2
(45) Date of Patent: Oct. 28, 2014

(54) GRIP BAND

(71) Applicant: Christopher L. Harris, Frisco, TX (US)

(72) Inventor: Christopher L. Harris, Frisco, TX (US)

( * ) Notice: Subject to any disclaimer, the term of this patent is extended or adjusted under 35 U.S.C. 154(b) by 21 days.

(21) Appl. No.: 13/929,596

(22) Filed: Jun. 27, 2013

(65) Prior Publication Data

US 2014/0213420 A1 Jul. 31, 2014

Related U.S. Application Data

(60) Provisional application No. 61/757,929, filed on Jan. 29, 2013.

(51) Int. Cl.
*A63B 71/00* (2006.01)
*A63B 71/14* (2006.01)

(52) U.S. Cl.
CPC ..... *A63B 71/14* (2013.01)
USPC ..... 482/139; 482/106; 2/161.1

(58) Field of Classification Search
USPC ..... 482/23, 92, 44, 105, 106, 139; 2/161.1
See application file for complete search history.

(56) References Cited

U.S. PATENT DOCUMENTS

| | | | | |
|---|---|---|---|---|
| 5,745,920 | A * | 5/1998 | Olivier | 2/170 |
| 5,898,944 | A * | 5/1999 | Vrany | 2/161.4 |
| 6,119,267 | A * | 9/2000 | Pozzi | 2/20 |
| 7,043,762 | B2 * | 5/2006 | Greenhalgh | 2/16 |
| 7,051,377 | B1 * | 5/2006 | Milner et al. | 2/159 |
| 8,267,844 | B2 * | 9/2012 | Kassel et al. | 482/139 |

* cited by examiner

*Primary Examiner* — Stephen Crow

(57) ABSTRACT

A grip band used for working out, has a wrist strap and a grip pad. The wrist strap is positioned around a user's wrist and provides the wrist with support, while the grip pad provides a grip surface having a high coefficient of friction, which enhances the user's grip. A proximal end of the grip pad is fixedly connected to the wrist strap, while a distal end can be removably attached. When in use the distal end is detached from the wrist strap and placed across the user's palm with the grip surface facing away from the palm. A finger strap ensures the grip pad remains in position across the palm. When not in use, the grip pad can be concealed by encircling the grip pad around the wrist strap and engaging a pad fastener with a strap fastener.

15 Claims, 9 Drawing Sheets

GRIP BAND

The current application claims a priority to the U.S. Provisional Patent application Ser. No. 61/757,929 filed on Jan. 29, 2013.

FIELD OF THE INVENTION

The present invention relates generally to workout gear. More specifically, the present invention is a wrist support strap with a dually integrated grip pad. Furthermore, the grip pad can be concealed around the wrist strap and deployed as needed.

BACKGROUND OF THE INVENTION

It is common for individuals to utilize certain types of workout gear in order to enhance their workout, especially when lifting weights. Both wrist straps and weightlifting gloves are common types of workout gear that are used for weight training. Wrist straps encircle a user's wrist and assist in keeping the wrist locked in a straight position. This additional support ensures that the user's wrist does not buckle when attempting to lift heavy loads. Weightlifting gloves, on the other hand, are designed to enhance a user's grip. High friction surfaces on these gloves help an individual to better hold onto and lift heavier loads. Additionally, these gloves provide a safety measure as they can prevent an individual for prematurely losing grip on a weight, which could result in injury to the user or a surrounding individual. While weightlifting gloves can be beneficial they are not always needed for every exercise and thus they must be removed from time to time and carried around by the user. As weightlifting gloves can be difficult to remove during or after a workout, weightlifting pads have also been developed. These pads can be more readily attached or removed from a user's hand than traditional weightlifting gloves, however, they must still be carried around when not in use.

Therefore it is the object of the present invention to provide a grip band that provides the function of both a weightlifting strap and a weightlifting glove. The present invention has a wrist strap and a concealable grip pad. The wrist strap is worn around a user's wrist and provides support much like a traditional weightlifting strap, while the grip pad enhances a user's grip and prevents calluses and bruising on the user's hand. One end of the grip pad is permanently fixed to the wrist strap, while the other free end may be temporarily attached to the wrist strap. The free end is detached from the wrist strap when the grip pad is needed, allowing the grip pad to be positioned across the user's palm. When the grip pad is no longer needed, the free end can be reattached to the wrist strap, concealing the grip pad around the wrist strap. This allows for quick and easy removal of the grip pad from a user's hand, relieves the user from carrying around work out gear, and ensures that the grip pad is not misplaced.

DETAIL DESCRIPTIONS OF THE INVENTION

All illustrations of the drawings are for the purpose of describing selected versions of the present invention and are not intended to limit the scope of the present invention.

The present invention is a grip band that is used for working out. The grip band combines the functions of a wrist support strap and a weightlifting glove into a single readily accessible device. The grip band comprises a wrist strap 1 and a grip pad 11. The wrist strap 1 is fitted around a user's wrist and provides support by keeping the user's wrist locked in a straight position. This ensures that the user's wrist does not give out while lifting heavy weights. The grip pad 11 provides the grip band with the function of a weightlifting glove through the utilization of a high friction surface. The grip pad 11 also protects a user's hand against calluses, bruises, etc. that can occur from frequently lifting weights. When not in use, the grip pad 11 can readily be concealed around the wrist strap 1.

Figure 1:
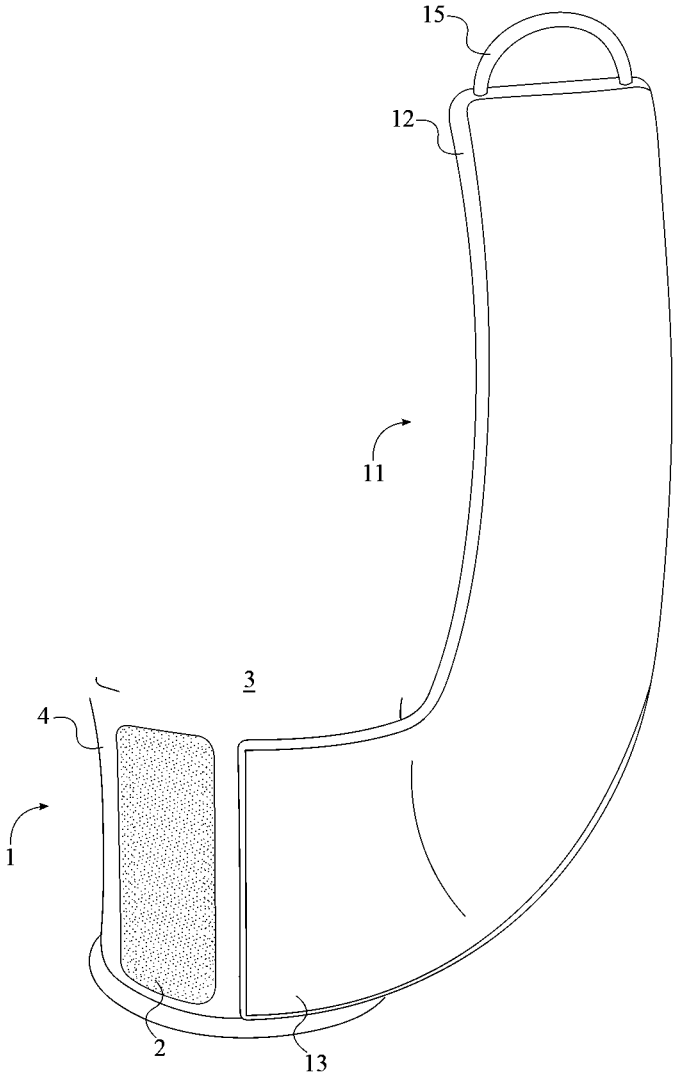
FIG. 1 is a front perspective view of the distal end being detached from the wrist strap.

In reference to FIG. 1, the wrist strap 1 comprises an inner surface 3, an outer surface 4, and a strap fastener 2. The inner surface 3 and the outer surface 4 are positioned opposite of each other on the wrist strap 1. The inner surface 3 is the portion of the wrist strap 1 that comes in contact with the user's skin. The inner surface 3 can be designed as a cushioned layer in order provide comfort to the user while the grip band is being used. Ideally, the inner surface 3 is constructed using a material or materials that will not irritate or otherwise damage a user's skin. The outer surface 4 forms the exterior of the wrist strap 1 and is the visible surface that is displayed when the grip pad 11 is in use. The outer surface 4 provides a contact surface on which the strap fastener 2 is positioned and to which the grip pad 11 is connected.

Figure 2:
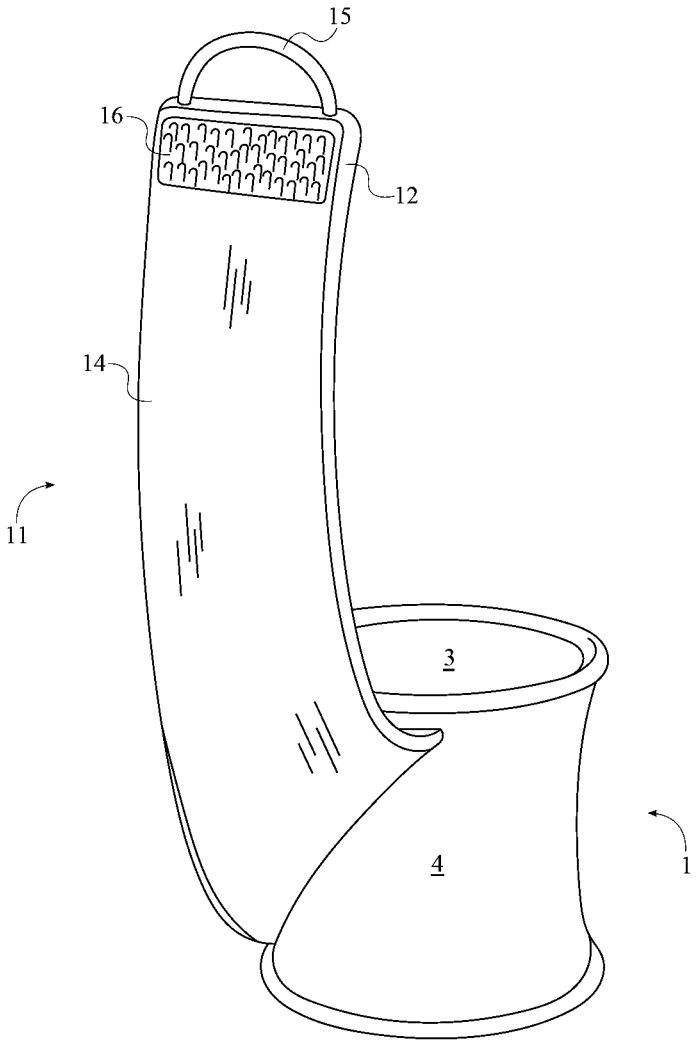
FIG. 2 is a rear perspective view of the distal end being detached from the wrist strap.

In reference to FIG. 2, the grip pad 11 is an elongated strip of material that is connected to the wrist strap 1. The grip pad 11 comprises a distal end 12, a proximal end 13, a grip surface 14, a finger strap 15, and a pad fastener 16. The distal end 12 and the proximal end 13 are positioned opposite of each other along the grip pad 11. The proximal end 13 is adjacently connected to the wrist strap 1 and acts as the fixed end of the grip pad 11. Unlike the proximal end 13, the distal end 12 may be either attached to the wrist strap 1 or detached from the wrist strap 1 depending on the user's needs.

In further reference to FIG. 2, the grip surface 14 is positioned along the grip pad 11 from the distal end 12 to the proximal end 13, and is designed to enhance a user's grip while lifting heavy weights. The coefficient of friction of the grip surface 14 is greater than the coefficient of friction of skin and, thus, the grip surface 14 provides the user with a greater frictional force between their hand and a weight. This allows a user to lift more weight and to do so in a safer manner. In the preferred embodiment of the present invention, the grip surface 14 is constructed from neoprene and has a shark skin pattern. However, any other material(s) can be used to construct the grip surface 14. Additionally, any other unique pattern may be used to further enhance the provided grip.

Figure 8:
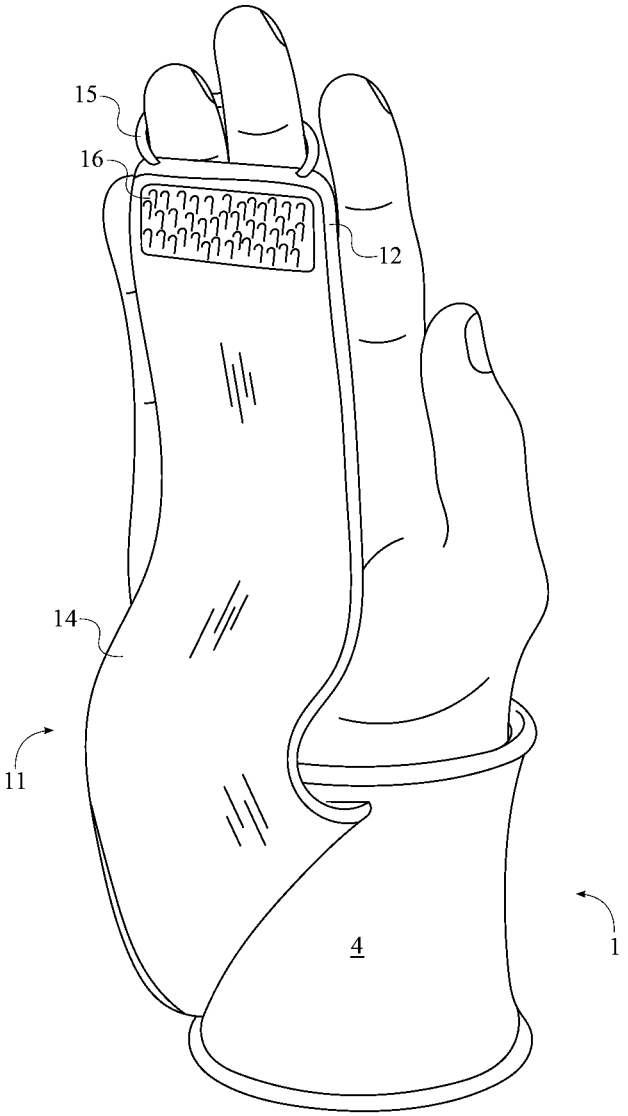
FIG. 8 is a perspective view of the grip band being attached around a user's wrist with the grip pad being deployed across the palm of the user.

When the grip pad 11 is in use, the distal end 12 is detached from the wrist strap 1 and the grip pad 11 is extended across the palm of the user's hand with the grip surface 14 facing away from the palm, as shown in FIG. 8. The finger strap 15 is then positioned around the user's middle finger and ring finger. The finger strap 15 is a length of material that is adjacently connected to the distal end 12. The finger strap 15 may be designed such that it has a fixed length or such that the length of the finger strap 15 is adjustable. Each end of the finger strap 15 is connected to the distal end 12 to form a looped portion through which the user positions his or her fingers. The finger strap 15 ensures that the grip pad 11 remains in the proper position across the user's hand, while the grip pad 11 is in use.

Figure 3:
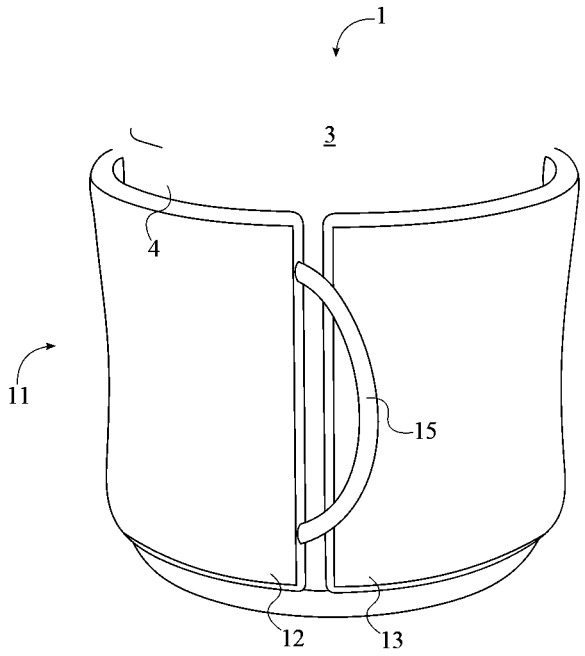
FIG. 3 is a perspective view of the grip band with the grip pad concealed around the wrist strap.
Figure 4:
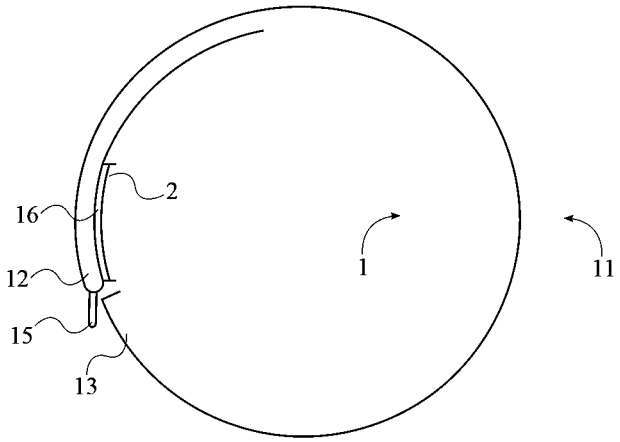
FIG. 4 is a top elevational view of the distal end being secured to the wrist strap by means of the pad fastener and the strap fastener.
Figure 9:
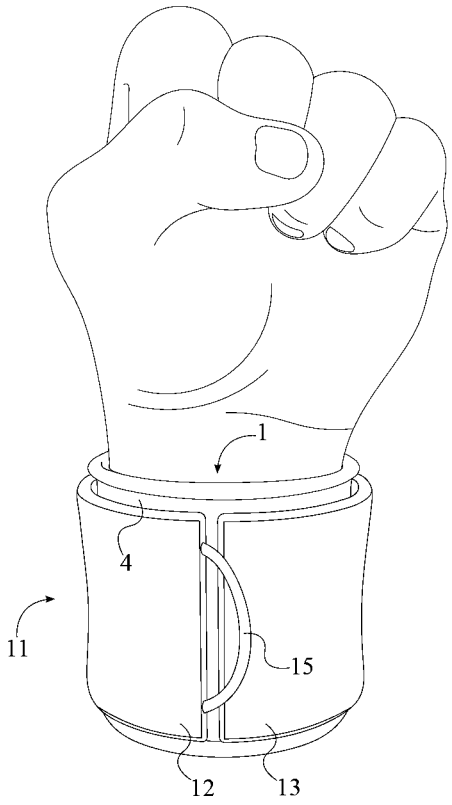
FIG. 9 is a perspective view of the grip band being attached around a user's wrist with the grip pad concealed around the wrist strap.

In reference to FIG. 3-4 and FIG. 9, the grip pad 11 can be concealed around the wrist strap 1 when the grip pad 11 is not in use. When concealed, the grip pad 11 encircles the wrist strap 1 around the outer surface 4. The pad fastener 16, which is positioned on the grip surface 14, adjacent to the finger strap 15, engages the strap fastener 2, thus securing the distal end 12 of the grip pad 11 to the wrist strap 1. When using other common weightlifting gloves or pads, if the gloves or pads are not needed for the current workout, then the user must remove and carry around the gloves or pads. With the present invention, a user can simply attach the distal end 12 to the wrist strap 1 to conceal the grip pad 11 and continue their workout. There is no hassle of removing a glove or pad and the user does not have to worry about misplacing a glove or pad.

In the preferred embodiment of the present invention, as shown in FIG. 1-4, the wrist strap 1 is elastic such that it can be slipped around a user's wrist. This allows for the grip band to be readily secured to a user's wrist or to be readily removed as desired. When the wrist band is elastic, the strap fastener 2 is positioned adjacent to the proximal end 13 of the grip pad 11. This placement of the strap fastener 2 allows the grip pad 11 to fully encircle the wrist strap 1, as the distal end 12 is attached to the wrist strap 1 adjacent to the proximal end 13, thus completely concealing the grip pad 11 with the wrist strap 1.

Figure 5:
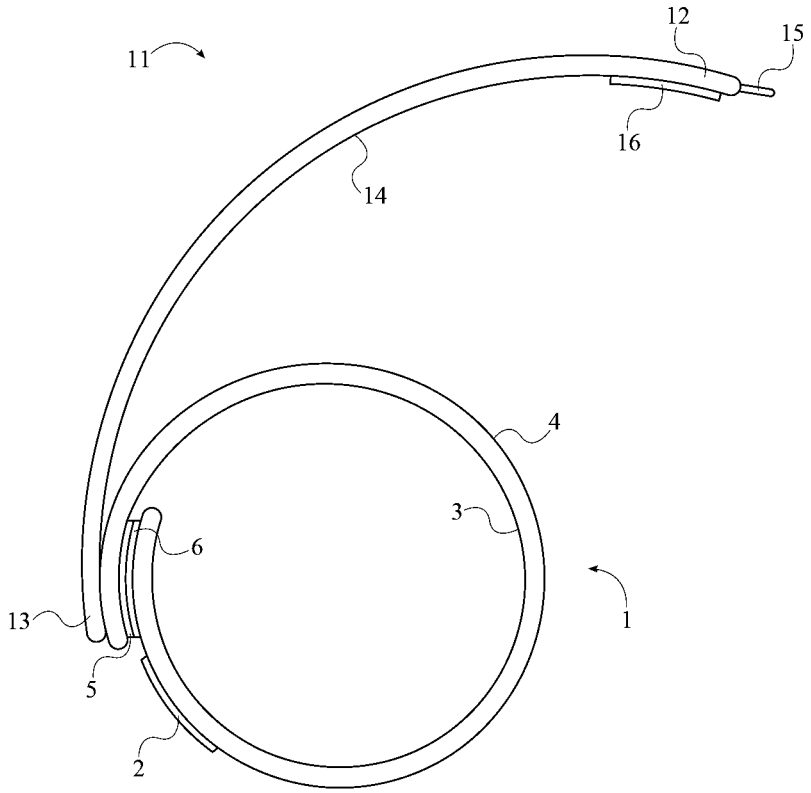
FIG. 5 is a top elevational view of the grip band in an alternative embodiment of the present invention.
Figure 6:
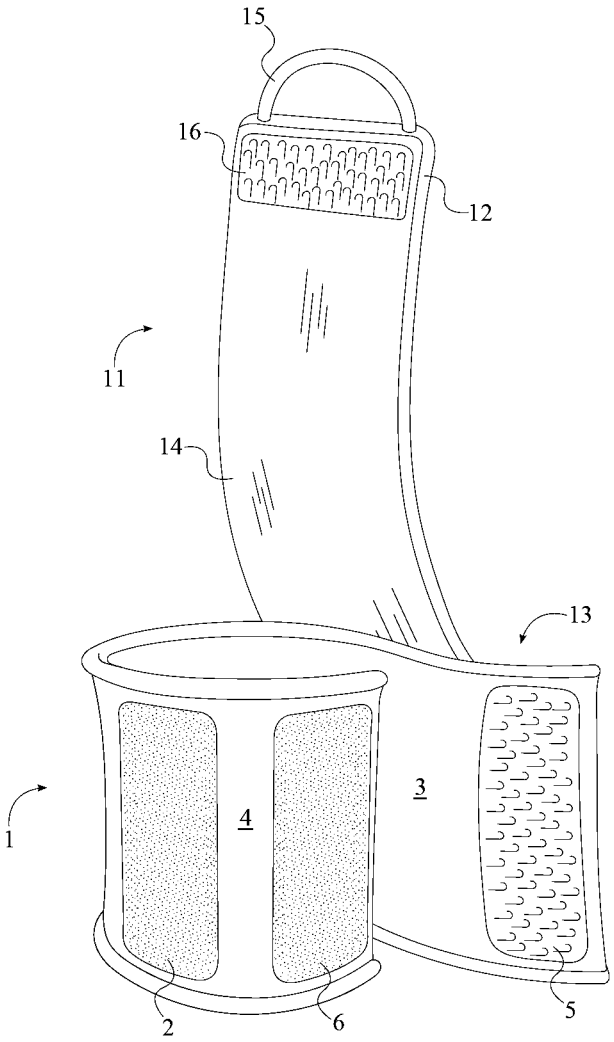
FIG. 6 is a perspective view of the proximal end being positioned adjacent to the first fastener in the alternative embodiment of the present invention.
Figure 7:
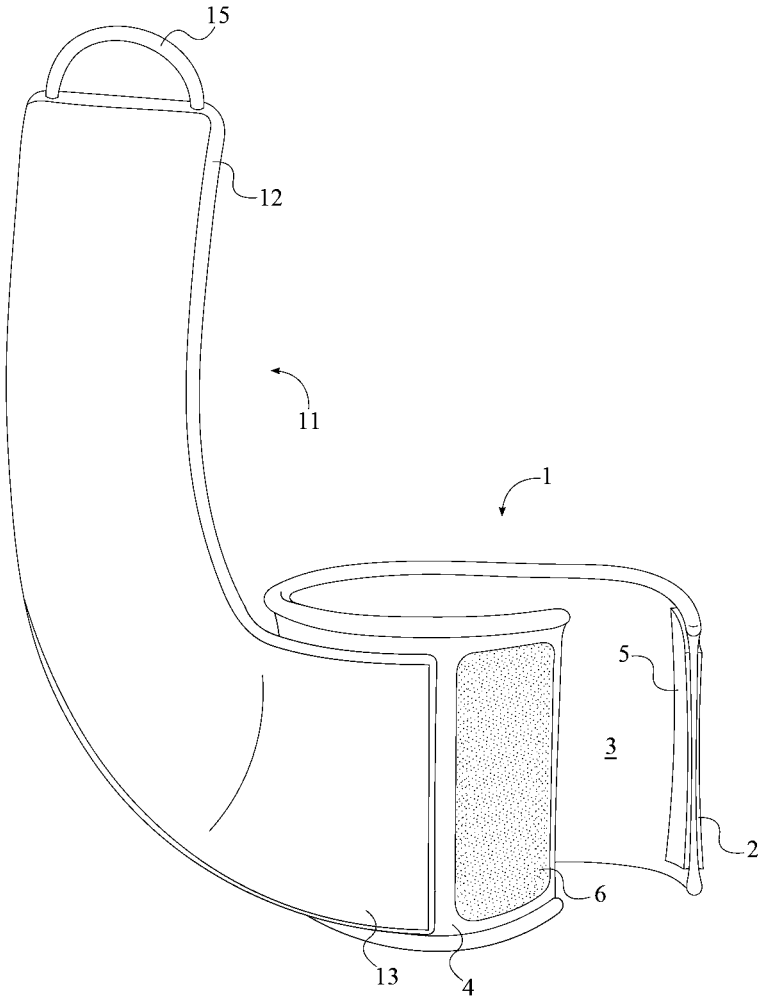
FIG. 7 is a perspective view of the proximal end being positioned adjacent to the second fastener in the alternative embodiment of the present invention.

In an alternative embodiment of the present invention, as shown in FIG. 5-7, the wrist strap 1 is designed such that it is secured around a user's wrist using fasteners. This allows the wrist band to be opened and have an adjustable loop size. The wrist strap 1 further comprises a first fastener 5 and a second fastener 6. The first fastener 5 and the second fastener 6 are positioned opposite of each other along the wrist strap 1, with the first fastener 5 being positioned on the inner surface 3 and the second fastener 6 being positioned on the outer surface 4. In this way, when the wrist strap 1 is encircled around a user's wrist, the first fastener 5 engages the second fastener 6 and both ends of the wrist strap 1 are held together, as shown in FIG. 5.

The proximal end 13 of the grip pad 11 can either be positioned adjacent to the first fastener 5 or adjacent to the second fastener 6, while the strap fastener 2 is positioned opposite of the proximal end 13 along the wrist strap 1. Thus, if the proximal end 13 is positioned adjacent to the first fastener 5, then the strap fastener 2 is positioned adjacent to the second fastener 6, as shown in FIG. 6. Similarly, if the proximal end 13 is positioned adjacent to the second fastener 6, then the strap fastener 2 is positioned adjacent to the first fastener 5, as shown in FIG. 7. Each of these configurations ensures that the grip pad 11 fully encircles the wrist strap 1 when the grip pad 11 is in the concealed position.

Although the invention has been explained in relation to its preferred embodiment, it is to be understood that many other possible modifications and variations can be made without departing from the spirit and scope of the invention as hereinafter claimed.

What is claimed is:

1. A grip band comprises:
a wrist strap;
a grip pad;
the wrist strap comprises an inner surface, an outer surface, and a strap fastener;
the grip pad comprises a distal end, a proximal end, a grip surface, a finger strap, and a pad fastener;
the inner surface and the outer surface being positioned opposite of each other on the wrist strap;
the strap fastener being positioned on the outer surface;
the proximal end and the distal end being positioned opposite of each other along the grip pad;
the grip surface being positioned along the grip pad from the distal end to the proximal end;
the finger strap being adjacently connected to the distal end;
the pad fastener being positioned on the grip surface adjacent to the finger strap; and
the proximal end being adjacently connected to the outer surface.

2. The grip band as claimed in claim 1 comprises:
the strap fastener being positioned adjacent to the proximal end.

3. The grip band as claimed in claim 1 comprises:
the grip pad encircling the wrist strap around the outer surface; and
the pad fastener engaging the strap fastener.

4. The grip band as claimed in claim 1 comprises:
the wrist strap further comprises a first fastener and a second fastener;
the first fastener and the second fastener being positioned opposite of each other along the wrist strap;
the first fastener being positioned on the inner surface;
the second fastener being positioned on the outer surface; and
the proximal end and the strap fastener being positioned opposite of each other along the wrist strap.

5. The grip band as claimed in claim 4 comprises:
the proximal end being positioned adjacent to the first fastener.

6. The grip band as claimed in claim 4 comprises:
the proximal end being positioned adjacent to the second fastener.

7. The grip band as claimed in claim 4 comprises:
the first fastener engaging the second fastener.

8. The grip band as claimed in claim 1 comprises:
the wrist strap being elastic.

9. A grip band comprises:
a wrist strap;
a grip pad;
the wrist strap comprises an inner surface, an outer surface, and a strap fastener;
the grip pad comprises a distal end, a proximal end, a grip surface, a finger strap, and a pad fastener;
the inner surface and the outer surface being positioned opposite of each other on the wrist strap;
the strap fastener being positioned on the outer surface;
the proximal end and the distal end being positioned opposite of each other along the grip pad;
the grip surface being positioned along the grip pad from the distal end to the proximal end;

the finger strap being adjacently connected to the distal end;

the pad fastener being positioned on the grip surface adjacent to the finger strap;

the proximal end being adjacently connected to the outer surface;

the strap fastener being positioned adjacent to the proximal end; and the wrist strap being elastic.

10. The grip band as claimed in claim 9 comprises:

the grip pad encircling the wrist strap around the outer surface; and the pad fastener engaging the strap fastener.

11. A grip band comprises:

a wrist strap;

a grip pad;

the wrist strap comprises an inner surface, an outer surface, a first fastener, a second fastener, and a strap fastener;

the grip pad comprises a distal end, a proximal end, a grip surface, a finger strap, and a pad fastener;

the inner surface and the outer surface being positioned opposite of each other on the wrist strap;

the first fastener and the second fastener being positioned opposite of each other along the wrist strap;

the first fastener being positioned on the inner surface;

the second fastener and the strap fastener being positioned on the outer surface;

the proximal end being positioned opposite of the distal end along the grip pad;

the grip surface being positioned along the grip pad from the distal end to the proximal end;

the finger strap being adjacently connected to the distal end;

the pad fastener being positioned on the grip surface adjacent to the finger strap;

the proximal end being adjacently connected to the outer surface; and the proximal end and the strap fastener being positioned opposite of each other along the wrist strap.

12. The grip band as claimed in claim 11 comprises:

the grip pad encircling the wrist strap around the outer surface; and the pad fastener engaging the strap fastener.

13. The grip band as claimed in claim 11 comprises:

the proximal end being positioned adjacent to the first fastener.

14. The grip band as claimed in claim 11 comprises:

the proximal end being positioned adjacent to the second fastener.

15. The grip band as claimed in claim 11 comprises:

the first fastener engaging the second fastener.

* * * * *